US006840714B1

(12) United States Patent
Vache

(10) Patent No.: US 6,840,714 B1
(45) Date of Patent: Jan. 11, 2005

(54) FOUNDATION REPAIR BRACKET

(76) Inventor: Raymond Edward Vache, 605 Sheffield Dr., Richardson, TX (US) 75081

( * ) Notice: Subject to any disclaimer, the term of this patent is extended or adjusted under 35 U.S.C. 154(b) by 26 days.

(21) Appl. No.: 10/621,537

(22) Filed: Jul. 17, 2003

(51) Int. Cl.[7] ..... E02D 7/02
(52) U.S. Cl. ..... 405/230
(58) Field of Search ..... 405/229–232

(56) References Cited

U.S. PATENT DOCUMENTS 4,673,315 A 6/1987 Shaw
4,765,777 A * 8/1988 Gregory ..... 405/230
4,911,580 A 3/1990 Gregory
4,925,345 A 5/1990 McCown
5,492,437 A * 2/1996 Ortiz ..... 405/230
5,951,206 A * 9/1999 Gregory ..... 405/230

* cited by examiner

*Primary Examiner*—Sunil Singh

(57) ABSTRACT

A bracket assembly used for raising and supporting the foundation or slab of a building. The assembly includes a cylindrical sleeve, lifting beam, spacer and two removable flanges to which a hydraulic or screw lifting system is attached. The assembly is used where the lifting bracket is installed under a foundation and a piling inserted through the sleeve and force into the ground by the lifting system attached to the top of the piling. Cost saving is realized since the flanges are removed after the building has been leveled and reused at subsequent jobs.

5 Claims, 5 Drawing Sheets

FOUNDATION REPAIR BRACKET

BACKGROUND OF THE INVENTION

1. Field of Invention

This invention relates to the equipment used to level a foundation, specifically using hydraulic lifting systems and pilings driven through a bracket supporting the foundation.

2. Background of the Invention

Prior art has suggested a method for raising a building foundation by means of a support bracket through which a piling is driven to bedrock. The bracket includes a horizontal beam used to support the foundation, a vertical sleeve and two side flanges used to attach a hydraulic lifting system. The bracket is welded together to form an inseparable assembly.

After the foundation is raised to the desired location, the bracket continues to function as a support when attached or pinned to the piling The hydraulic system and linkages are removed and any piling above the bracket is removed.

At this point, the side flanges do not contribute to the foundation support.

SUMMARY OF THE INVENTION

It is therefore the object of the present invention to provide a more economical support bracket by allowing the side flanges to be removed after the leveling process and reused. It is also the object of the present invention to attach the side flanges to the bracket using only one threaded screw with a nut and one shouldered pin. The obvious benefit of simple attachment of the side flanges is speed of assembly and disassembly.

It is still further the object of this invention to locate the fasteners in the most accessible locations to allow disassembly where clearance is limited by the foundation and piling.

DRAWING

Figures

The summary of the invention and detailed description of the invention will be more fully appreciated reference to the following drawings.

Figure 1:
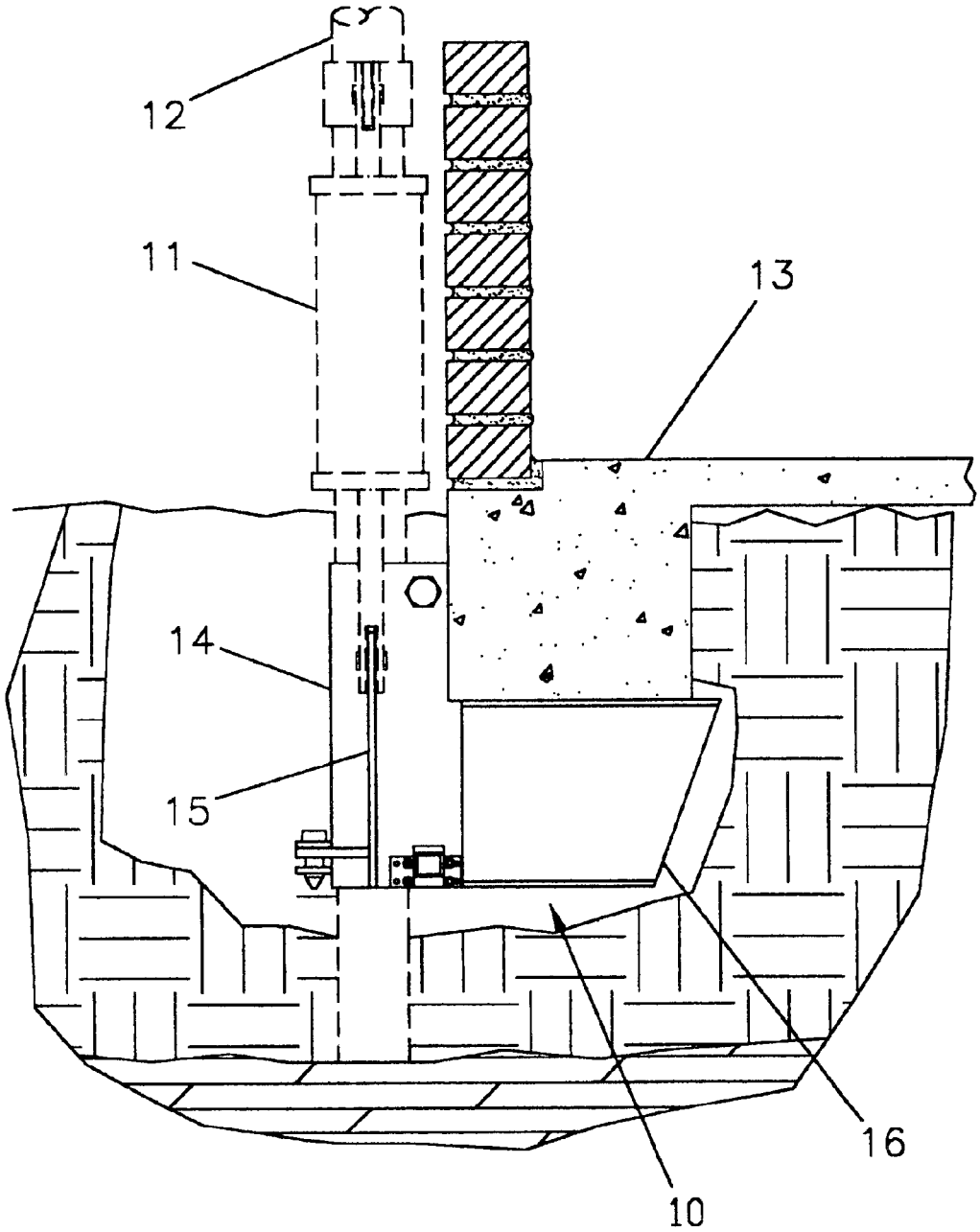
FIG. 1 is a cross-sectional view of the foundation and structure with the bracket, piling, hydraulic system and linkages installed preparatory to leveling.

| DRAWINGS-Reference Numerals | |
|---|---|
| 10 | bracket assembly |
| 11 | lifting system |
| 12 | piling |
| 13 | building foundation |
| 14 | cylindrical sleeve |
| 15 | flange |
| 16 | cantilever beam |
| 17 | spacer |
| 18A | upper retainer plate |
| 18B | lower retainer plate |
| 19 | right retainer plate |
| 20 | shouldered pin |

-continued

| DRAWINGS-Reference Numerals | |
|---|---|
| 21 | threaded screw |
| 22 | nut |
| 23 | latch bar |
| 24 | lifting system attaching hole |
| 25L | flange mounting hole |
| 25R | flange mounting hole |
| 26 | right flange hole |
| 27 | left flange hole |
| 28 | upper retainer hole |
| 29 | right retainer hole |
| 30 | lower retainer hole |
| 31 | beam notch |
| 32 | flange rect. hole |
| 33 | pin retainer |
| 34 | pin retainer |
| 35 | pin |
| 36 | latch notch |
| 37 | latch concave surface |

DETAILED DESCRIPTION

Figure 3:
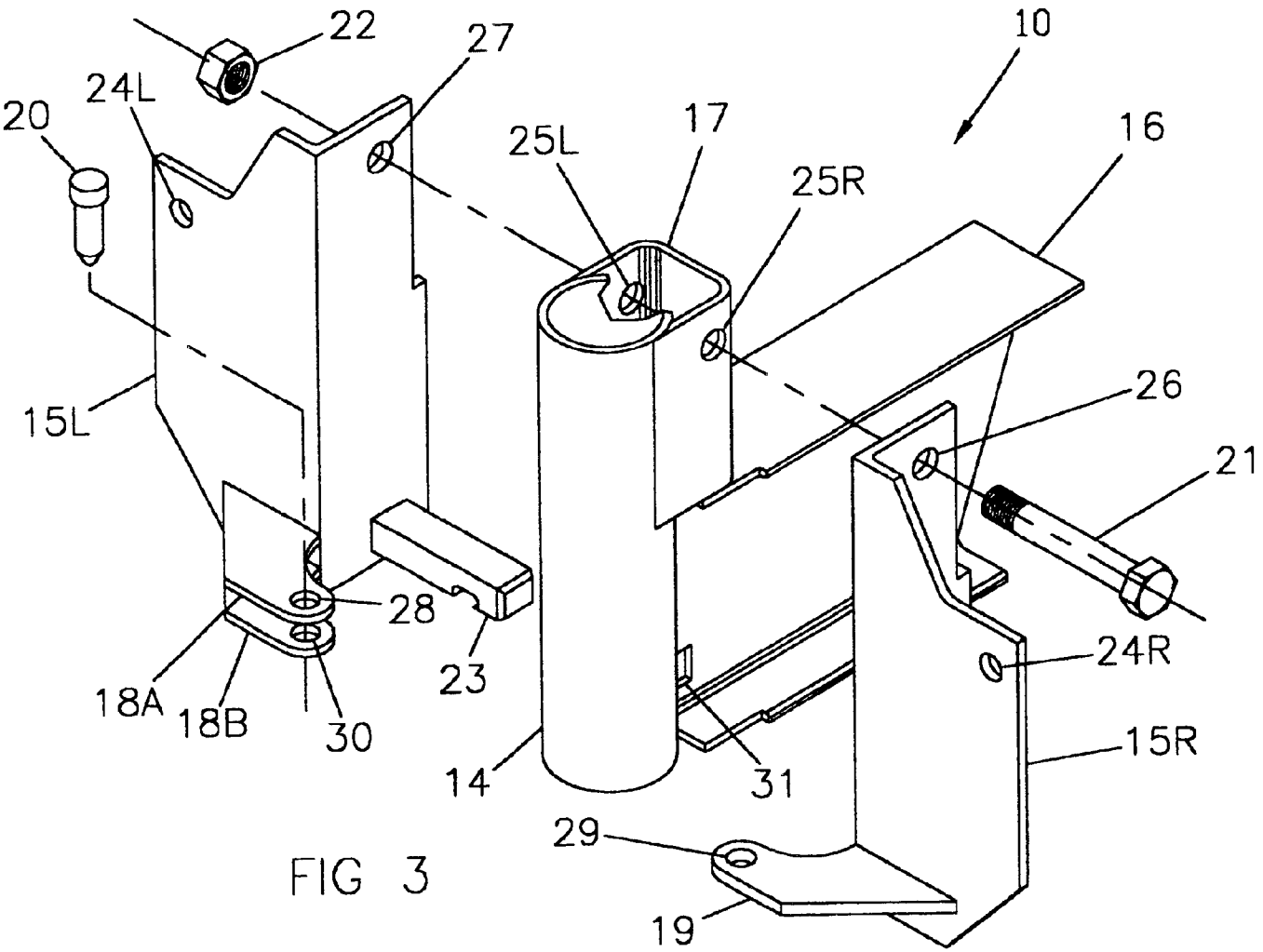
FIG. 3 is an exploded view of the bracket.

FIG. 3 shows the bracket assembly placed under a building foundation 13. Reference number 10 refers in general to the bracket assembly. Prior art suggests a piling 12 is driven through the bracket sleeve 14 by means of a hydraulic system and linkages 11 connected to flanges 15 attached to the sleeve.

The building foundation is raised by a cantilever beam 16 applying force to the underside of the foundation. The cantilever beam is permanently attached to the sleeve.

Figure 2:
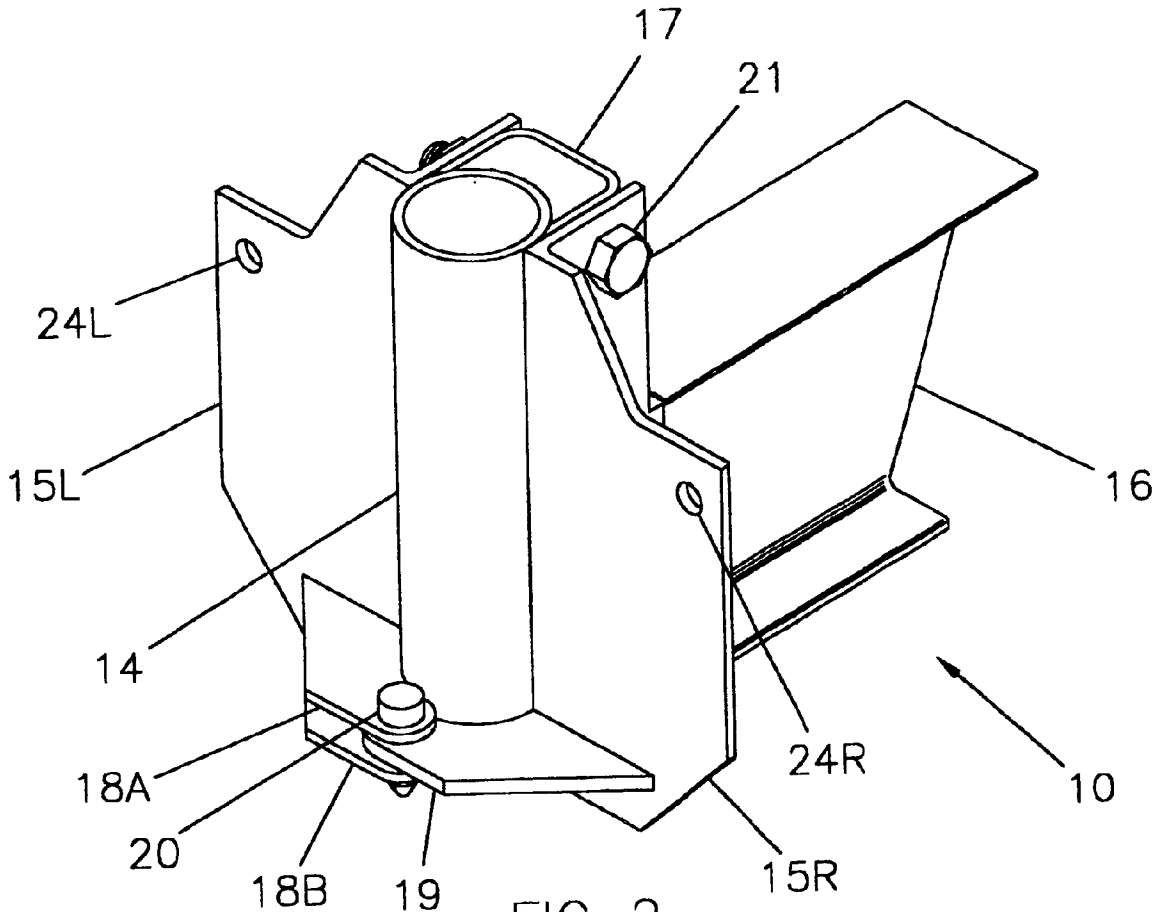
FIGS. 2 and 4 are perspective views of the bracket.

FIG. 2 shows a perspective view of the bracket 10 as assembled to be inserted ation.

FIG. 3 shows an exploded perspective view of the bracket with the flanges 15L and 15R removed. The right flange 15R has a mounting hole 24R used for attachment of a hydraulic system. The right flange also has a clearance hole 26 which accepts a threaded screw 21 that extends through the clearance holes 25R and 25L of a channel-shaped spacer 17 when assembled. The threaded screw also extends through the clearance hole 27 of the left flange 15L and is retained by a threaded nut 22.

The threaded screw which retains the two flanges to the channel-shaped spacer transfers the vertical forces acting on the flanges to the sleeve and cantilever beam.

A pair of retainer plates 18A and 18B is permanently attached to the left flange 15L. An opposing retainer plate 19 is permanently attached to the right flange 15R When filly assembled, the retainer plate holes 28, 29 and 30 align to accept a shouldered pin 20. The shouldered pin inserted into the retainer plate clearance holes provides resistance to the moment forces resulting from the lifting motion of the hydraulic system.

A latch bar 23 is permanently attached to the left flange 15L. When the left flange is assembled, the latch bar extends through a rectangular hole 31 in the cantilever beam 16.

Figure 4:
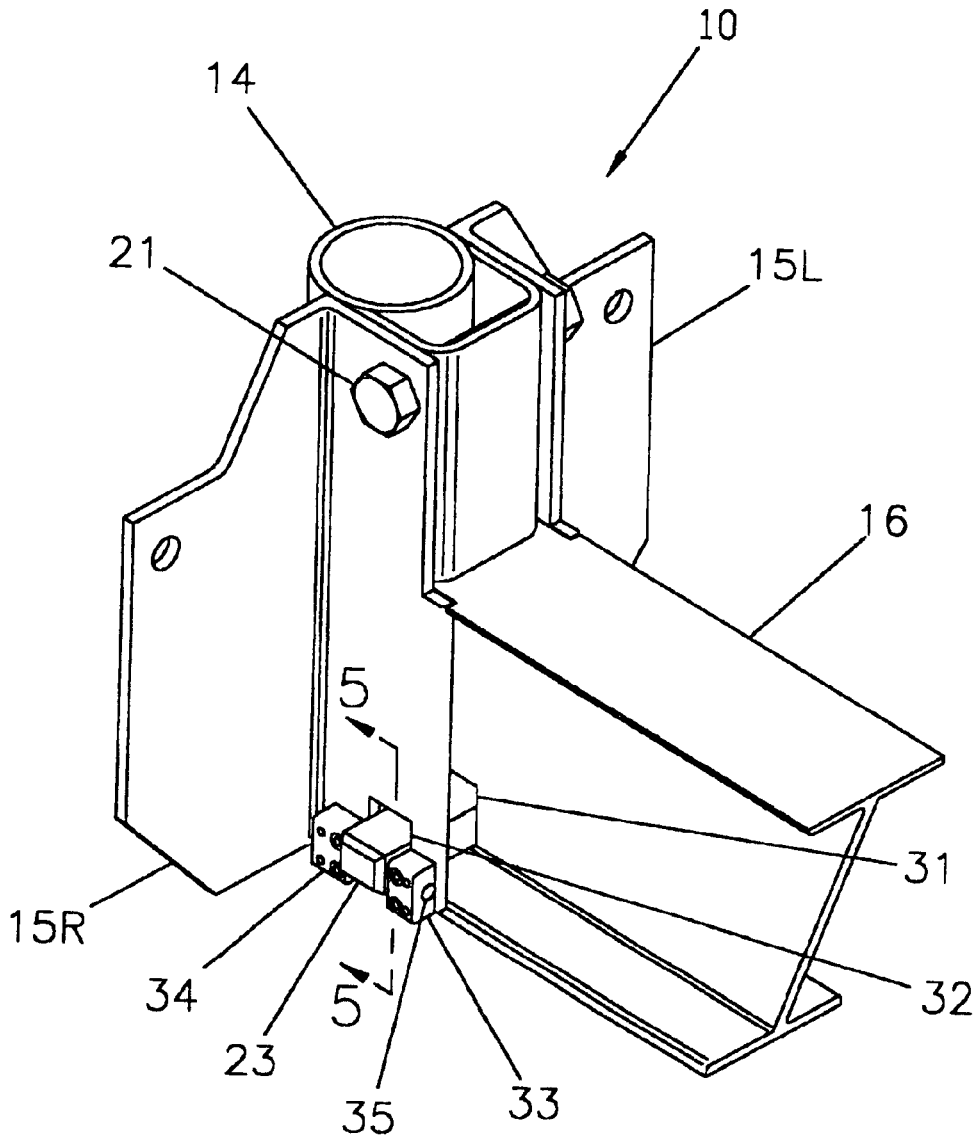
Figure 5:
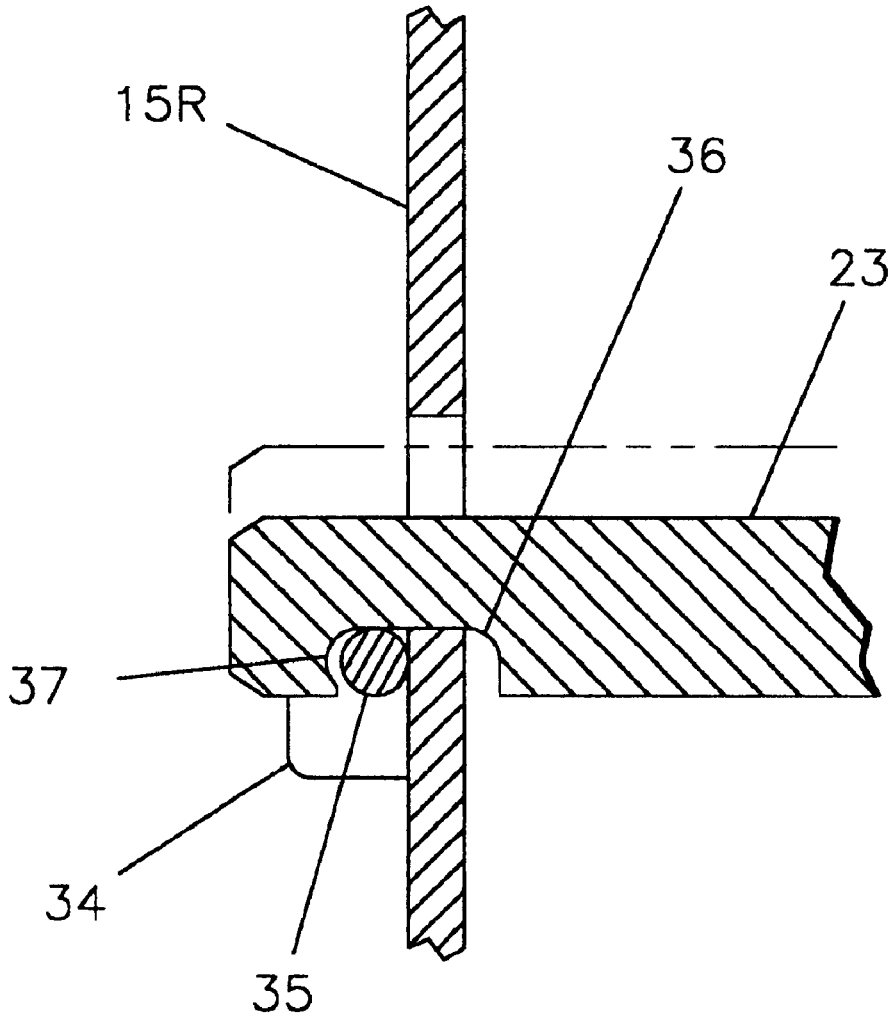
FIG. 5 is an enlarged sectional view of the flange latch bar and cylindrical pin.

FIG. 4 shows the latch bar also extending through a rectangular hole 32 in the right flange 15R and sandwiched between two pin retainers 33 and 34. The latch bar 23 has a notch 36. The outside edge of the notch 37 is a concave surface that engages a cylindrical pin 35. The pin extends across the full width of the lower edge of the rectangular hole 31 and is secured by pin retainers 33 and 34. The pin retainers are permanently attached to the right flange 15R. The concave surface 37 of the latch bar 23 engaging the cylindrical pin 35 eliminates the possibility of disengagement resulting from the extreme force of the lifting operation.

The hydraulic system 11 imparts a load to the flanges 15L and 15R which produces a tensile stress shared by the retainer plates 18A, 18B, 19 and the latch bar 23. The latch bar also resists a bending load at its midpoint caused by the upward motion of the hydraulic system translating to the flanges and pivoting about the threaded screw 21.

The latch bar maintains a parallel orientation between the sleeve 14 and the flanges 15L and 15R.

Vertical clearance is provided between the retainer plates 18A and 18B and rectangular holes 31 and 32 to allow the latch bar 23 to pass over the pin 35. The flanges 15L and 15R are then translated vertically to align the latch bar concave surface 37 with the cylindrical pin 35. At this point, the clearance holes 25R and 25L of the channel-shaped spacer align with the clearance holes 27 and 26 of the flanges 15L and 15R respectively. The threaded screw 21 is inserted in the aligned holes and the nut 22 installed.

The shouldered pin 20 is then installed which fully constrains the flanges to the sleeve 14, channel-shaped spacer 17 and cantilever beam 16.

A clearance of approximately 1/32 of an inch is provided between the latch bar concave surface 37 and the cylindrical pin 3S to allow the bar to traverse downwardly over the pin. The latch bar urges against the cylindrical pin when the hydraulic system 11 lifts the bracket assembly 10 and the flanges 15L and 15R deflect about the screw 21 and nut 22.

After the foundation 13 is leveled and the bracket assembly 10 is secured to the piling 12, the shouldered pin 20, threaded screw 21 and nut 22 are removed. The left flange 15L is lifted vertically to disengage the latch bar 23 from the pin 35. Both flanges 15L and 15R are then removed for future use.

I claim:

1. A device for raising and supporting a foundation or slab of a building, said device comprising:

a. a cantilever beam having top and bottom sides, said top side engaging the underside of said foundation, also having a notched end with said notch located near said bottom side, and b. a cylindrical sleeve used to guide a piling driven into the ground, having approximately the same diameter as the beam, also having a top end and a bottom end, joined perpendicularly to said notched end of the beam, the sleeve essentially flush with said bottom side of the beam, and c. a spacer joined to said cylindrical sleeve and engaging the side of said foundation providing clearance between a structure wall and an actuator system, said spacer protruding from the sleeve approximately two inches, having about the same width as said cantilever beam and said cylindrical sleeve, extending from the vertex of the beam and sleeve to said top end of the sleeve, also having a through hole near the top end of said spacer, perpendicular to the longitudinal axis of the beam, and d. two removable angle flanges of right hand and left hand configuration, each flange with a top end and a bottom end having about the length of said cylindrical sleeve, said top end of each flange essentially adjacent to the sleeve top end, with opposing flanges oriented to have a leg extending outwardly from the sleeve and perpendicular to the beam, each flange having 90° complementary legs sandwiching the beam, sleeve and spacer, each flange having a means for attachment of a lifting device, each flange having holes near said top end of said complementary leg which align with said through hole, thereby providing a first means for securing the flanges to said spacer when a screw is inserted through the flange holes and through hole and a nut attached thereto.

2. The device of claim 1 wherein one said angle flange has a latch bar permanently attached near said bottom end and extending through the beam notch to provide a second means for securing said angle flanges, said latch bar also urges against said cylindrical sleeve thereby resisting moment forces about said screw.

3. The device of claim 2 wherein said opposing angle flange has a rectangular through hole with a pin attached to the flange and located adjacent to the lower outside edge of said rectangular hole, providing a cylindrical bearing surface for said latch bar.

4. The device of claim 3 wherein the latch bar has a downward facing notch with a concave surface which mates to said pin providing a positive latch to resist lateral sliding forces resulting from lifting motion.

5. The device of claim 4 wherein said angle flanges have a plurality of horizontal plates permanently attached to form a hinge-like connection through which a removable pin is inserted thereby providing third means for connecting said angle flanges.

* * * * *